US006641412B2

(12) United States Patent
Kitagawa et al.

(10) Patent No.: US 6,641,412 B2
(45) Date of Patent: Nov. 4, 2003

(54) AC ADAPTER THAT CAN NARROW THE BLADE DISTANCE WHEN THE PLUG IS STORED IN THE CASE

(75) Inventors: Hisayoshi Kitagawa, Iizuka (JP); Hidetoshi Hamai, Iizuka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/166,464

(22) Filed: Jun. 10, 2002

(65) Prior Publication Data

US 2002/0187667 A1 Dec. 12, 2002

(30) Foreign Application Priority Data

Jun. 11, 2001 (JP) ..... 2001-175816

(51) Int. Cl.[7] ..... H01R 13/44
(52) U.S. Cl. ..... 439/131
(58) Field of Search ..... 439/131, 172, 439/173, 518, 52, 104, 106, 528; 174/48

(56) References Cited

U.S. PATENT DOCUMENTS 6,042,400 A * 3/2000 Queffelec et al. ..... 439/131
6,053,750 A * 4/2000 Waible ..... 439/106
6,179,633 B1 * 1/2001 Inada ..... 439/131
6,241,538 B1 * 6/2001 Chen ..... 439/131
6,273,734 B1 * 8/2001 Ikeda et al. ..... 439/131
6,275,002 B1 * 8/2001 Chen ..... 320/111
6,312,271 B1 * 11/2001 Tseng ..... 439/131
6,325,646 B1 * 12/2001 Uemura et al. ..... 439/131
6,398,566 B1 * 6/2002 Chen ..... 439/131

FOREIGN PATENT DOCUMENTS

| | | |
|---|---|---|
| JP | 5-152026 | 6/1993 |
| JP | 5-326030 | 12/1993 |
| JP | 6-084563 | 3/1994 |
| JP | 11-224717 | 8/1999 |
| JP | 11-329562 | 11/1999 |
| JP | 3075110 | 11/2000 |

* cited by examiner

*Primary Examiner*—P. Austin Bradley
*Assistant Examiner*—Phuongchi Nguyen
(74) *Attorney, Agent, or Firm*—Ladas & Parry

(57) ABSTRACT

An AC adapter having a dual-bodied plug that can be rotated by 90 degrees relative to the adapter case so that the plug can be stored in the case when the adapter is not used and drawn out of the case when the adapter is in use. A blade distance adjusting unit provided in the case adjusts the distance between the blades of the plug. When the plug is drawn out of the case, the distance between the blades is increased up to the predetermined value. When the plug is stored in the case, the distance between the blades is reduced. The AC adapter can use a thinner case than conventional AC adapters of which plugs are monolithically structured.

5 Claims, 9 Drawing Sheets

AC ADAPTER THAT CAN NARROW THE BLADE DISTANCE WHEN THE PLUG IS STORED IN THE CASE

BACKGROUND OF THE INVENTION

1. Field of the Invention

The present invention relates to an AC adaptor, and more particularly, to an AC adapter with a rotative plug.

2. Description of the Related Art

AC adapters are used for various purposes such as the recharging of mobile phones and the converting of AC voltage into a desired AC voltage or a DC voltage.

For compactness and mobility, an AC adapter sometimes has a plug that can be stored in the case of the AC adapter by rotating the plug by 90 degrees to the case.

By reference to FIGS. 9A and 9B, a description on a conventional AC adapter will be given below. FIG. 9A is the front view of the AC adapter, and FIG. 9B is the cross sectional view of the AC adapter in FIG. 9A.

The AC adapter 1 is provided with a case 2 formed by insulating resin and a plug 3. The plug 3 consists of blades 4*a* and 4*b* that are made of conductive metal material and a holder 5 that is formed by molding resin material to hold an edge of each of blades 4*a* and 4*b*. A circuit board (not shown) that converts AC voltage into DC voltage is provided in the case 2.

A rotative axis 6 is extruded from the holder 5 of the plug 3. A bearing unit 7 that supports the rotative axis 6 is provided in the case 2. The plug 3 can rotate around the rotative axis 6 up to 90 degrees in the rotative direction shown by an arrow in FIG. 9A, between a state where the plug 3 is stored in the case 2 (shown by a dotted line in FIG. 9A) and another state where the plug 3 is extracted from the case 2 (shown by a solid line in FIG. 9A) for connection with an outlet (not shown). The holder unit 5 of the AC plug 3 has contacting units that are connected to the respective blades. On the other hand, the circuit board in the case 2 is provided with contacts made of leaf spring, for example. The contacting units elastically touch the contacts when the plug 3 is rotated. The detailed explanation will be given later.

In the AC adapter 1 described above, the blades 4*a* and 4*b* of the plug 3 are provided on opposite sides of the rotative axis 6 in a fashion where the wide faces of the blades face each other.

The AC adapter 1 that can store the plug 3 internally is used in a state where the plug 3 is raised after a 90-degree rotation or in a state where the plug 3 is further locked with an interlocking mechanism using a protrusion and a notch (not shown).

However, since the plug of a conventional AC adapter has a monolithic structure of blades and a holder, it is necessary to have enough space in the case of the AC adapter to store the plug, which is an obstacle to designing a small case, that is, a small AC adapter.

SUMMARY OF THE INVENTION

Accordingly, it is a general object of the present invention to provide a novel and useful AC adapter in which one or more of the problems described above are eliminated.

Another and more specific object of the present invention is to provide an AC adapter in which the size of the case can be reduced by reducing the distance between two blades of the plug when the plug is stored in the case.

According to an aspect of the present invention, an AC adapter includes a case, a plug that can be rotated by 90 degrees about one axis relative to said case, so that said plug can be stored in said case and drawn out of said case, and a blade distance adjusting unit, wherein said plug further comprises a pair of sub-holders, each holding a blade, said blade distance adjusting unit causes at least one of said pair of sub-holders to slidingly approach the other to reduce the distance between the blades when said plug is stored in said case, and to slidingly separate from the other to increase said distance between the blades when said plug is drawn out of said case.

Accordingly, when the plug is drawn out of the case, the two sub-holders separate from each other so that the distance between the blades increases up to the predetermined value. On the other hand, when the plug is stored in the case, the two sub-holders approach each other, or even contact, so that the distance between the blades is reduced. The AC adapter according to the present invention can use a thinner case than conventional AC adapters of which plugs are monolithically structured.

The AC adapter according to the present invention described above is characterized in that said plug has a rotative axis perpendicular to a plane in which said plug is rotated to be drawn out of said case, said case has a bearing unit that supports said rotative axis of said plug, said blade distance adjusting unit comprises a tongue unit formed on one of the sub-holders, said blade distance adjusting unit further comprises a convex stripe unit formed near said bearing unit, said convex stripe unit being substantially "L"-shaped, and said tongue unit is guided by said convex stripe unit when said plug is rotated around said rotative axis so that said distance between the blades is adjusted.

In this aspect, a stopper unit of an appropriate structure is provided at a certain position in the case. When the plug is drawn out of the case, one of the sub-holders is stopped by the stopper unit so that the distance between the blades is adjusted to a predetermined value.

That the AC adapter described above is further characterized in that said plug has a rotative axis perpendicular to a plane in which said plug is rotated to be drawn out of said case, said case has a bearing unit that supports said rotative axis of said plug, said blade distance adjusting unit comprises a protrusion unit formed on a side face of the sub-holders, said blade distance adjusting unit further comprises a guiding ditch unit formed near said bearing unit, said guiding ditch unit being substantially "L"-shaped, and said protrusion unit is guided by said guiding ditch unit when said plug is rotated around said rotative axis so that said distance between the blades is adjusted.

In this aspect, the distance between the rotative axis and the ditch unit is set at a predetermined value so that, when the plug is raised out of the case, the distance between the blades becomes a predetermined value. A stopper having an appropriate structure is provided at a certain position in the case. When the plug is raised out of the case, the stopper stops the sub-holder so that the distance between the blades is set at a predetermined value.

The AC adapter according to the present invention described above further includes a circuit board provided in said case, and is characterized in that each of the sub-holders has a stick-shaped contacting unit extruded in parallel to said rotative axis, said contacting unit being electrically connected to the blade held by the sub-holder, a pair of elastic contacts facing each other stand on said circuit board, said contacting unit separates from the contact when said plug is stored in said case and touches the contact when said plug is drawn out of said case.

Even in the long run, the elastic contacts damage the contacting units much less than inelastic contacts do and sustain good electric connection.

Other objects, features, and advantages of the present invention will become more apparent from the following detailed description when read in conjunction with the accompanying drawings.

DETAILED DESCRIPTION OF THE PREFERRED EMBODIMENTS

A detailed description of the preferred embodiments will be given below by reference to the drawings.

An AC adapter according to the first embodiment of the present invention will be described by reference to FIGS. 1–5.

Figure 1:
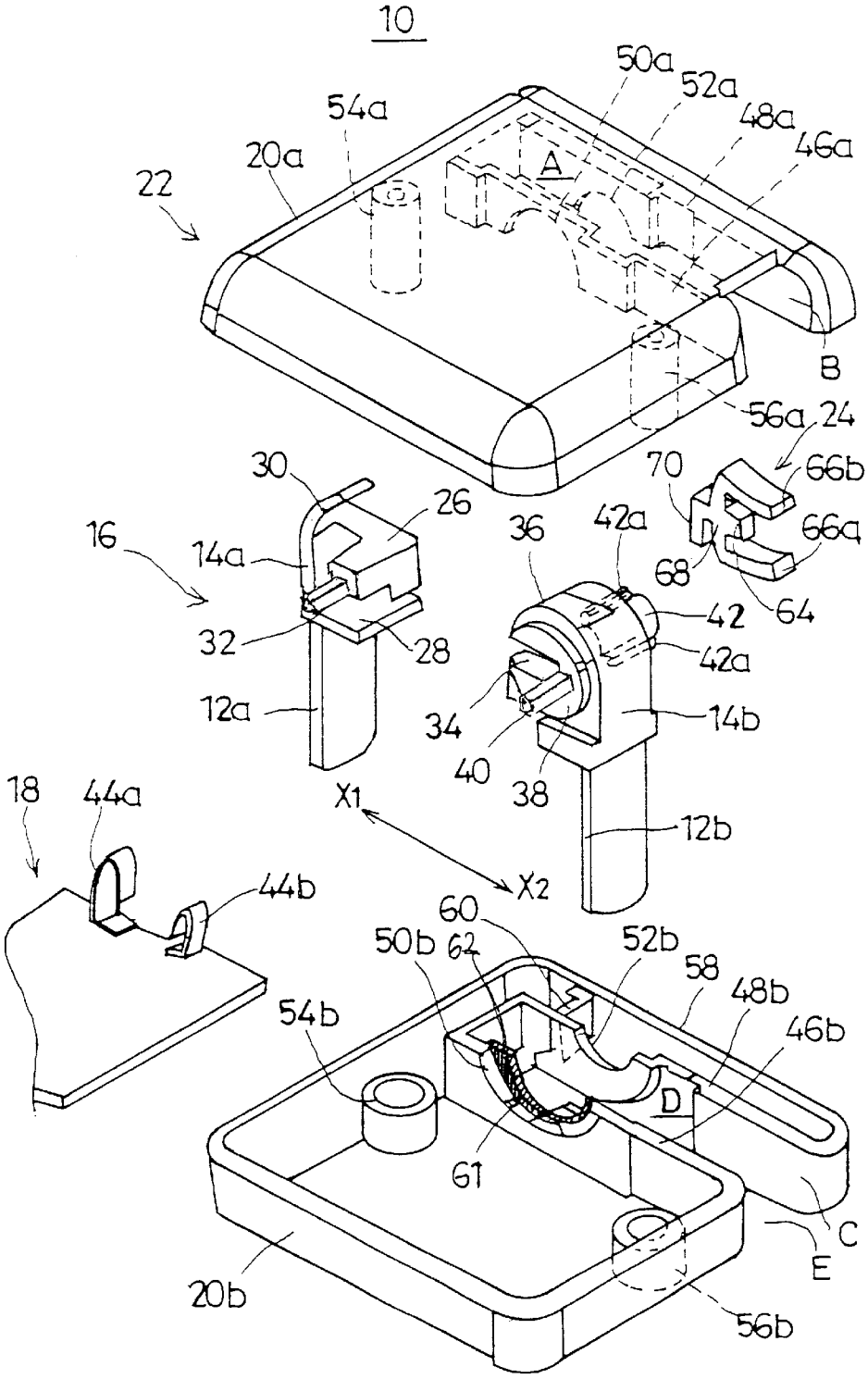
FIG. 1 is an exploded view of an AC adapter as the first embodiment of the present invention.

As showed in FIG. 1, the AC adapter 10 as the first embodiment of the present invention is mainly structured by a plug 16, a circuit board 18, and a case 22. The plug 16 consists of two holder half units 14*a* and 14*b* made of insulating resin, for example, and respective conductive metal blades 12*a* and 12*b* extruded out of the holder half units. The blades constitute a pair. The circuit board 18 converts AC voltage into DC voltage. The case 22 consists of the case upper half unit 20*a* and a case lower half unit 20*b* both made of insulating resin, for example, and stores the plug 16 and the circuit board 18. A reference numeral 24 indicates a component made of elastic artificial resign, for example, which is used with the plug 16 to create a "click" feeling.

The holder half unit 14*a* has a rectangular unit 26 formed step-wise, a plate unit 28 formed at a distance from the rectangular unit 26, and a tongue unit 30 extruded on a side of the rectangular unit 26 in a circular arc-wise direction. A stick-shaped contacting unit 32 made of conductive metal is provided on a side of the rectangular unit 28.

The holder half unit 14*b* has a circular cylindrical unit 36 on which a concave unit 34 is formed step-wise on a side. A rotative axis 38 extends on a face that is perpendicular to the face on which the concave unit 34 of the circular cylindrical unit 36 is formed. A stick-shaped contacting unit 40 made of conductive metal is provided on the rotative axis 38. A rotative axis 42 is also provided on the opposite side from which the contacting unit 40 is provided. On the outer diameter of the rotative axis 42, a plurality of concavities and convexities 42*a* are formed.

Figure 2:
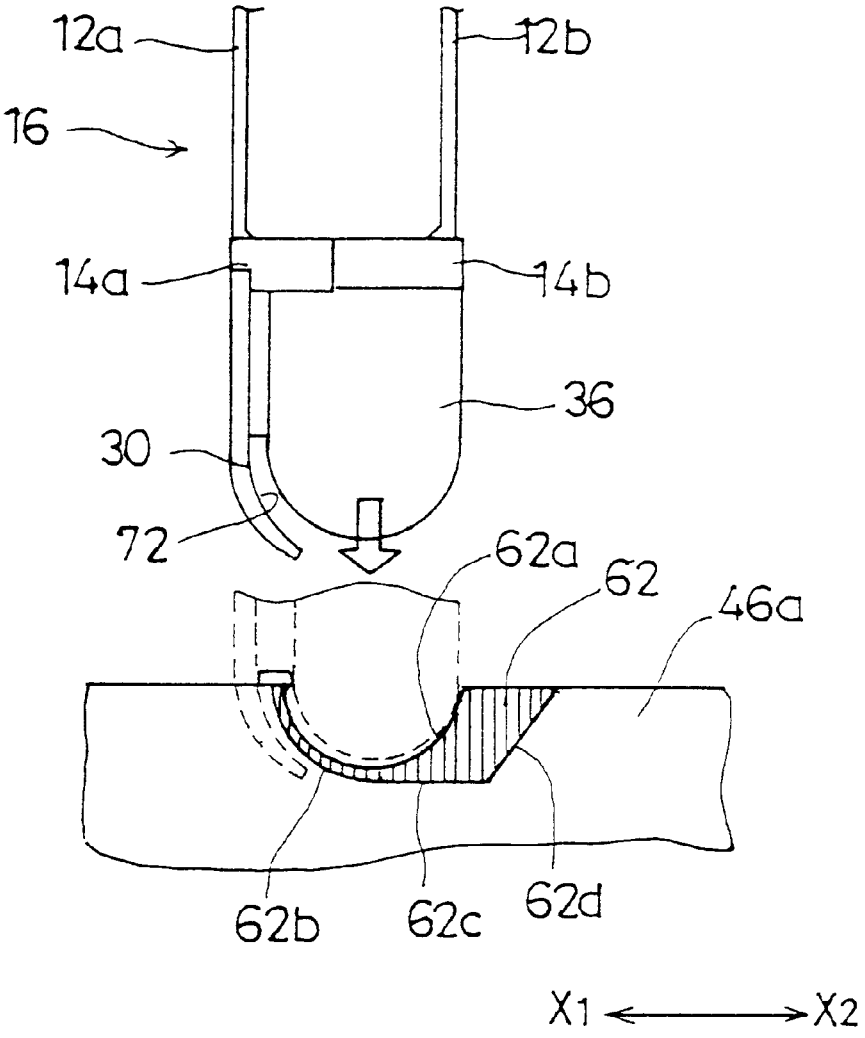
FIG. 2 is a schematic drawing showing how a plug is attached to the AC adapter showed in FIG. 1.

Two holder half units 14*a* and 14*b* are combined by tightly fitting the rectangular unit 26 and the concave unit 34, and constitute the plug 16. As shown in FIG. 2, when the holder half units 14*a* and 14*b* are combined, a circular gap (groove) 72 is formed between the tongue unit 30 and the circular cylindrical unit 36. The two holder half units 14*a* and 14*b* can be separated in the direction X1–X2 as showed in FIG. 1.

On the circuit board 18, a pair of contacts 44*a* and 44*b* made of conductive metal and having U-shaped tops stands facing each other.

In the case upper half unit 20*a*, a pair of vertical wall unit 46*a* and 48*a* between which the plug 16 is stored is provided facing each other. One side of the space "A" between the vertical wall units 46*a* and 48*a* is connected to an opening "B" formed on a side face. Two semi-circle-shaped bearing half units 50*a* and 52*a* are formed on the wall units 46*a* and 48*a*. The reference marks 54*a* and 56*a* each indicate a circular cylindrical unit having a hole to insert stopping members.

The case lower half unit 20*b* substantially corresponds to the case upper half unit 20*a*, and is provided with a pair of vertical wall units 46*b* and 48*b* having respective bearing half units 50*b* and 52*b*, and circular cylindrical units 54*b* and 56*b*. However, in the case lower half unit 20*b*, an opening "E" connected to the space "D" between the wall units is provided on the bottom face as well as on the side face.

When the AC adapter 10 is assembled, the bearing half units 50*a* and 50*b*, and the bearing half units 52*a* and 52*b* form bearing units, respectively.

A convex stripe unit 62 (showed with hatching in FIG. 1) is formed on a side face of the bearing half unit 50*b*. The convex stripe unit 62 will be described in more detail later.

The click feeling creation member 24 consists of a bottom unit 64, two elastic nail units 66*a* and 66*b*, and a base unit 68 combining the bottom unit 64 and the two elastic nail units 66*a* and 66*b*, and further consists of an L-shaped stopping unit 70 on the opposite side of the base unit 68.

When one assembles the AC adapter 10 including the above components, the circuit board 18 is first fixed to the case lower half unit 20*b*. Then, two holder half units 14*a* and 14*b* are combined by being fitted together tightly. Next, the click feeling creation member 24 is attached to the rotative axis 42. The outer circle of the rotative axis 42 touches the bottom unit 64. The nails of the elastic nail unit 66*a* and 66*b* stop the concave portions of the rotative axis 42. The rotative axis 42 and the rotative axis 38 are positioned on the bearing half unit 52*b* and the bearing half unit 50*b*, respectively, and the stopping unit 70 is tightly fitted to the protrusion unit 60 to attach the plug 16 and the click feeling creation member 24 to the case lower half unit 20*b*. Furthermore, the case lower half unit 20*b* is covered with the case upper half unit 20*a* by carefully positioning corresponding portions between the case upper half unit 20*a* and the case lower half unit 20*b*. Finally, the assembly of the AC adapter 10 is completed by inserting and fixing stopping members (not shown) such as screws through the holes of the circular cylindrical units 54*a*, 54*b*, 56*a*, and 56*b*.

A description on the convex stripe unit 62 of the bearing half unit 46*b* is given below by reference to FIG. 2. As indicated by the reference mark 62*a*, the inner circle of the convex stripe unit 62 is formed circular-arc-wise in parallel to the bearing half unit 50*b*. However, the outer edge of the convex stripe unit 62 is formed by three portions 62*b*, 62*c*, and 62*d*. The portion 62*b* is formed circular-arc-wise in parallel to the inner bearing face of the bearing half unit 50*b* between the horizontal direction and the downward direction forming an angle of 90 degrees with the horizontal direction. The portion 62*b* is followed by the horizontal straight portion 62*c*, and further followed by the straight portion 62*d* that forms an obtuse angle with the straight portion 62*c*. The distance between the bearing face and the portion 62*d* is greater than the distance between the bearing face and the portion 62*c*, and the distance between the bearing face and the portion 62*c* is greater than the distance between the bearing face and the portion 62*b*.

The plug 16 consisting of two combined holder half units 14*a* and 14*b* is positioned downward to the case lower half unit 20*b*, and the gap 72 formed between the tongue unit 30 and the circular cylindrical unit 36 is fitted and related to the convex stripe unit 62. When the plug 16 is rotated by 90 degrees in the rotative direction as showed in FIG. 2 and positioned along the X1–X2 directions, the plug 16 is stored in the case lower half unit 20*b*.

Additionally, in the completed AC adapter 10, when the plug 16 is further rotated downward by 90 degrees, the tongue unit 30 moves along the outer edge of the convex stripe unit as a guide, and the blades 12*a* and 12*b* of the plug 16 are drawn out of the case 22 through the opening E. The detailed explanation will be given later.

By reference to FIGS. 3A, 3B, 4A, and 4B, the operation of the plug 16 of the AC adapter 10 will be described below. FIGS. 4A and 4B correspond to FIGS. 3A and 3B, respectively. FIGS. 4A and 4B schematically depict only the relationship between the holder half unit 14*a* holding the blade 12*a* and the convex stripe unit showed in FIGS. 3A and 3B.

Figure 3A:
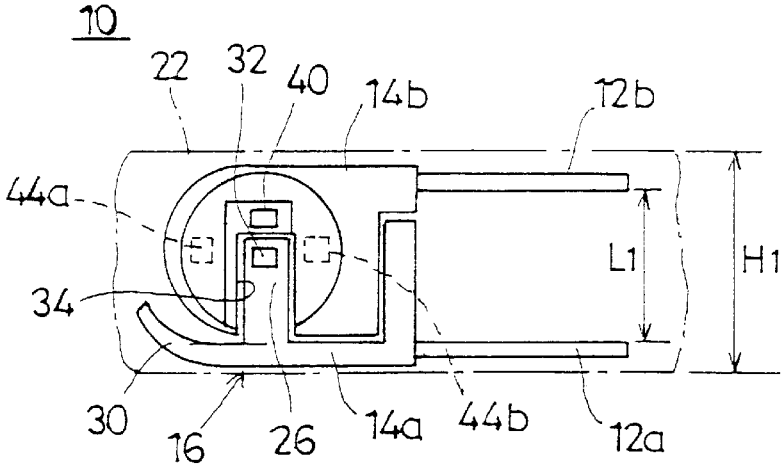
FIG. 3A is a schematic drawing showing the movement of the plug of the AC adapter showed in FIG. 1 where blades are stored in the case.
Figure 4A:
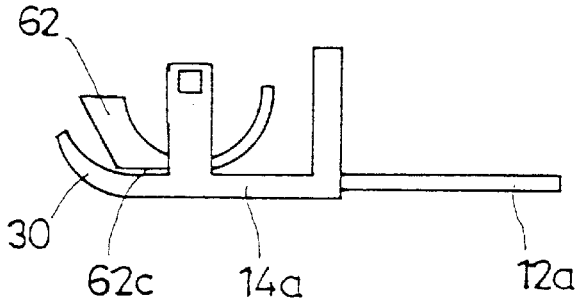
FIG. 4A is a schematic drawing showing one of the half portions of the holder and the protrusion in a state corresponding to FIG. 3A for further description about the movement of the plug included in the AC adapter showed in FIG. 3A.
Figure 4B:
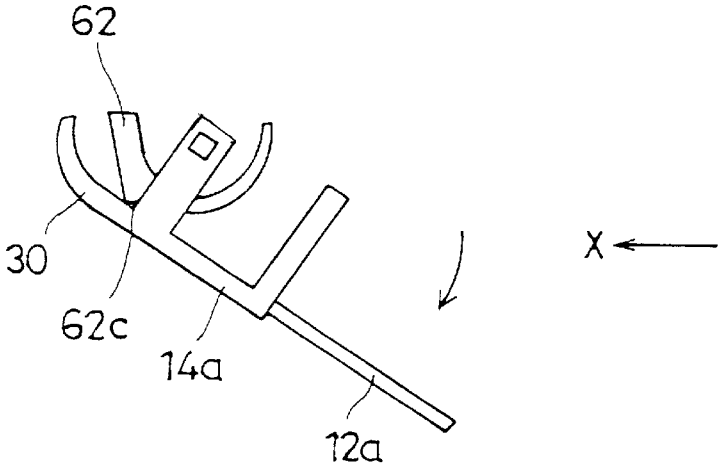
FIG. 4B is a schematic drawing showing the half portion of the holder showed in FIG. 4A in a state corresponding to FIG. 3B.

As showed in FIG. 3A, when the AC adapter 10 is not in use, the plug 16 is stored in the case 22, which makes the AC adapter 10 handy to carry. When the plug 16 is stored in the case 22, the tongue unit 30 is related to the boundary portion of the circular arc unit 62*b* and the horizontal straight unit 62*c*. Accordingly, while the plug 16 is stored in the AC adapter 10, the two holder half units 14*a* and 14*b* are set in a state where the rectangular unit 26 completely enters the concave unit 34 and the two holder half units 14*a* and 14*b* are set most closely together. The thickness H1 of the case 22 depends on the distance L1 between the blades 12*a* and 12*b* in this state.

Figure 3B:
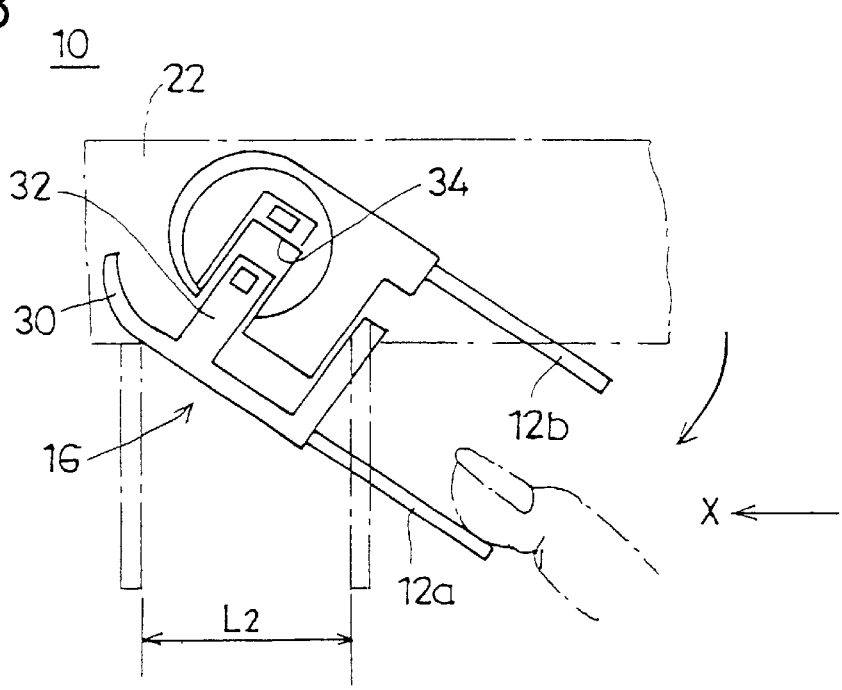
FIG. 3B is a schematic drawing showing the movement of the plug of the AC adapter showed in FIG. 1 where blades are raised out of the case.

As showed in FIG. 3B, when a user uses the AC adapter 10, the user is required to insert his/her finger through the opening "C" (see FIG. 1) on the side face of the case 22 to catch the blade 12*a*, and draw the blade 12*a* downward through the opening "E" (see FIG. 1) on the bottom face of the case 22. The blade 12*b* automatically follows the blade 12*a* and is drawn out of the case 22 together with the blade 12*a*. When the blade 12*b* is drawn out of the case 22, the holder half unit 14*b* rotates around the rotative axes 38 and 42 (see FIG. 1).

As showed in FIG. 4B, as to the holder half unit 14*a* holding the blade 12*a*, the tongue unit 30, moving off the bearing unit 50*b* (or the rotative axis), moves horizontally (in the direction indicated by "X" in FIG. 3B and 4B) along the straight portion 62*c* of the convex stripe unit. Since the rectangular unit 26 recedes from the innermost space in the concave unit 34, the holder half unit 14*a* and the holder half unit 14*b* separate. Accordingly, the tongue unit 30 and the convex stripe unit 62 operate as a blade distance adjusting unit.

As showed in FIG. 3B, when the blade 12*a* is drawn out of the case by rotating the blade 12*a* by 30 degrees downward, for example, the blades 12*a* and 12*b* are distant by L2. Even when the blade 12*a* is drawn 90 degrees downward out of the case, the blades 12*a* and 12*b* keep the same distance of L2. When the holder half unit 14*a* separating from the holder half unit 14*b* is rotated by 90 degrees, the back face of the tongue unit 30 moves along a stopper unit (not shown) of the case 22, and the holder half unit 14*a* is fixed at that position. The holder half unit 14*a* does not separate from the holder half unit 14*b* more than the predetermined distance L2.

The plug 16 is rotated 90 degrees to be stored in the case 22 and drawn out of the case 22. On the other hand, the blade 12*a* slides to adjust the distance between the blades 12*a* and 12*b*.

When the blade 12*a* is drawn out of the case and the rotative axis 42 rotates, the concave and convex units 42*a* of the rotative axis 42 touch a pair of elastic nail units 66*a* and 66*b* of the click feeling creation member 24, which makes a user feel a comfortable clicking feeling.

The above distance L2 is a predetermined distance defined by the industrial standard and required whenever the AC adapter 10 is in use. In the case of the AC adapter as the first embodiment of the present invention, when the AC adapter is not in use, the distance between the blades is reduced so that the plug can be stored in a slim case. On the other hand, when the AC adapter is used, the blades are drawn out of the case with a finger and the distance between the blades becomes the predetermined distance.

Figure 5:
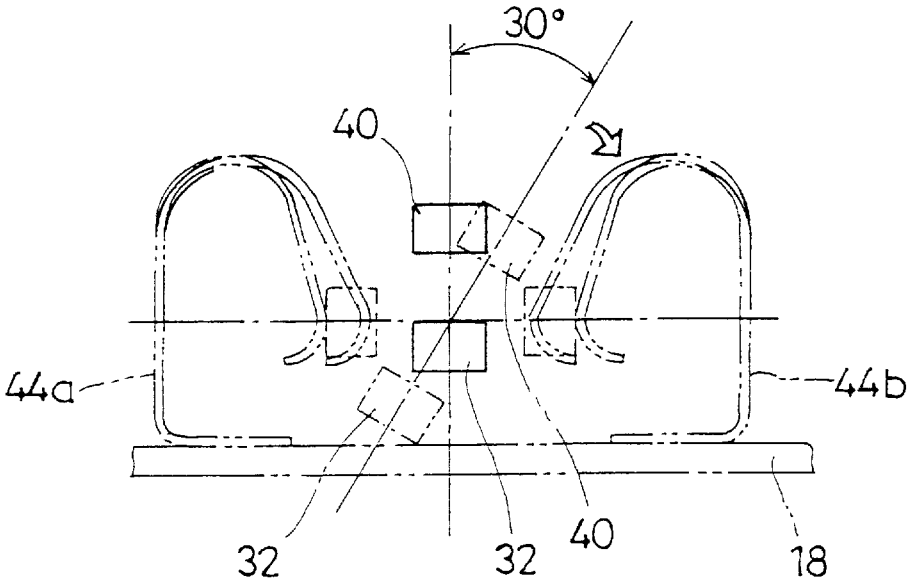
FIG. 5 is a schematic drawing showing the movement of a contacting unit relative to a contact of the AC adapter showed in FIG. 1.

The electric contacting mechanism between the contacting unit of the blade and the contact of the circuit board used in the AC adapter 10 as the first embodiment of the present invention will be described by reference to FIG. 5.

When the blades 12*a* and 12*b* are stored in the case 22, the contacting units 32 and 38 stay at a position that is rotated by 90 degrees relative to the contacts 44*a* and 44*b* standing on the circuit board 18 facing one another. When the blade 12*a* is rotated by 30 degrees, for example, and drawn out of the case 22 downward, the contacting units 32 and 38 touch the contacts 44*a* and 44*b*, respectively. When the blade 12*a* is further rotated up to the 90-degree position, the contacting units 32 and 38 touch and press elastically the contacts 44*a* and 44*b*. Accordingly, the electric contacting mechanism surely sustains the electric contact between the plug and the circuit board without a problem such as a wear-out failure where the contacting unit is worn out by repeatedly touching an inelastic contact.

A description of an AC adapter according to the second embodiment of the present invention will be given below by reference to FIGS. 6–8.

As to the AC adapter as the second embodiment of the present invention, the basic structure is identical to that of the AC adapter 10 shown in FIG. 1. Accordingly, as to the AC adapter as the second embodiment of the present invention, elements that are identical to those of the AC adapter 10 will be referred to by the same numerals, and their description will be omitted.

As to the AC adapter as the second embodiment of the present invention, the structure of the two holder half units and a case and the distance adjusting mechanism are different from those of the AC adapter 10 as the first embodiment of the present invention. The contacting units and the circuit board on which the contacts are provided are not shown in FIGS. 6–8.

Figure 6:
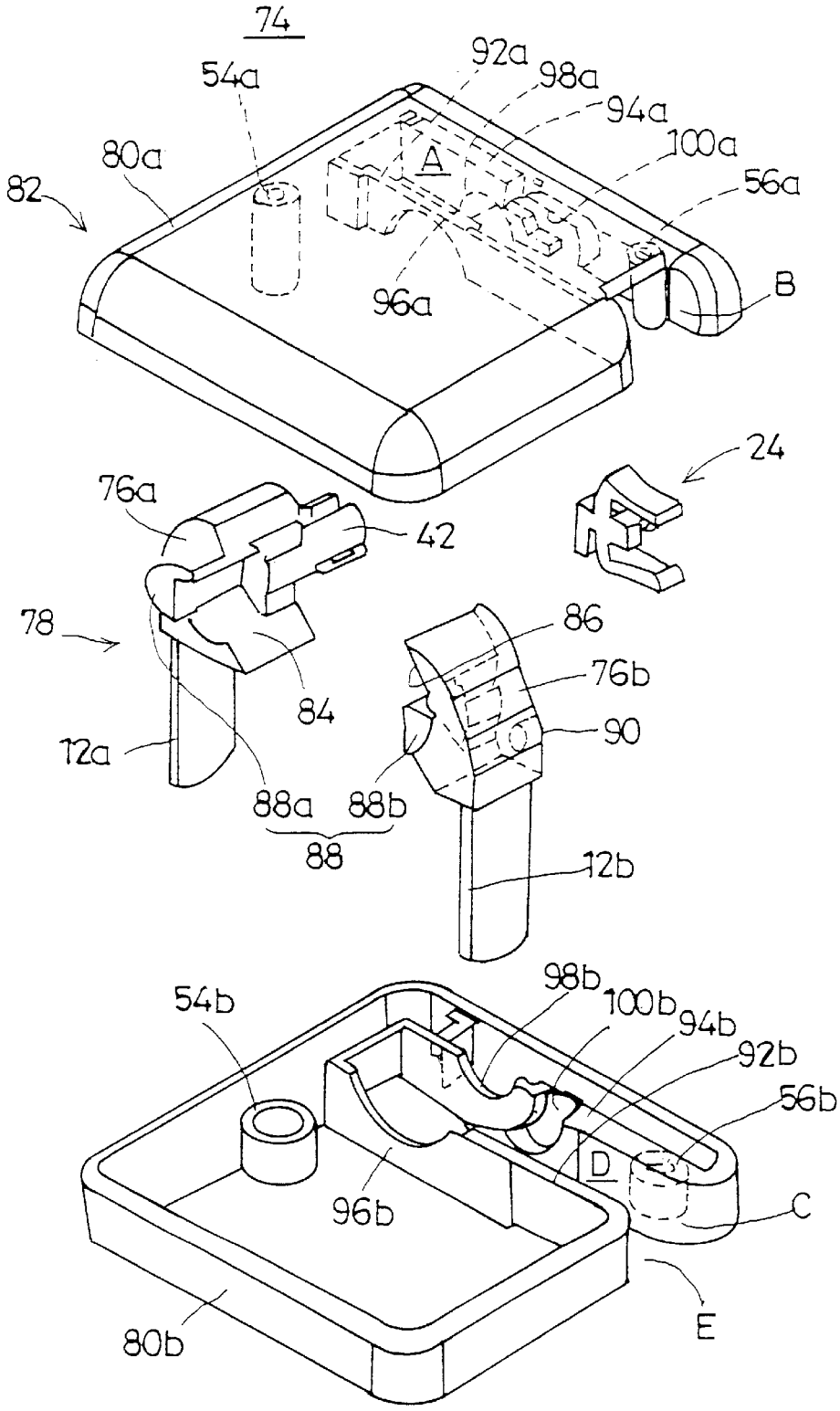
FIG. 6 is an exploded view of an AC adapter as the second embodiment of the present invention.

As shown in FIG. 6, the AC adapter 74 as the second embodiment of the present invention includes a plug 78 consisting of two holder half units 76*a* and 76*b* made of insulating resin, for example, from which a pair of conductive metal blades 12*a* and 12*b* are protruded, respectively, and a case consisting of case upper and lower half units 80*a* and 80*b* made of insulating resin that stores the plug 78 therein.

In the holder half units 76*a* and 76*b*, concave units 84 and 86 are formed so that the holder half units 76*a* and 76*b* can be combined by fitting tightly and be separated again. In the holder half unit 76*a*, a rotative axis 42 that is supported by the click feeling creating member 24 is provided, and the bearing half unit 88*a* is also provided on the other side. On the other hand, a rotative axis half unit 88*b* is provided in the holder half unit 76*b* and constitutes a rotative axis 88 when the holder half unit 76*b* is combined with the holder half unit 76*a*. The holder half unit 76*b* has a protrusion unit 90 on the other side opposite to the side where the rotative axis half unit 88*b* is provided.

A pair of vertical wall units 92*a* and 94*a* is formed in the case upper half unit 80*a* for the storing of the plug 78. On vertical wall units 92*a* and 94*a*, semi-circle-shaped bearing half units 96*a* and 98*a* are formed, respectively. An L-shaped ditch unit 100*a* is formed near the bearing half unit 98*a* of the vertical wall unit 94*a*.

Corresponding to the case upper half unit 80*a*, a pair of vertical wall units 92*b* and 94*b* is formed in the case lower half unit 80*b*. On each vertical wall unit 92*b* and 94*b*, a bearing half unit 96*b* and 98*b* is formed, respectively. A ditch unit 100*b* is formed circular-arc-wise in parallel to the circular face of the bearing half unit 98*b*. The ditch unit 100*b* is connected to the ditch unit 100*a* when the AC adapter 74 is assembled.

As shown in FIG. 8, when the AC adapter 74 is assembled, the bearing half units 96*a* and 96*b* form a bearing unit, and the bearing half units 98*a* and 98*b* form another bearing unit. The ditch units 100*a* and 100*b* form an L-shaped ditch unit 100.

The operation of the plug 78 of the AC adapter 74 will be explained by reference to FIGS. 7A, 7B, 8A, and 8B. FIGS. 8A and 8B correspond to FIGS. 7A and 7B, respectively. FIGS. 8A and 8B show only the holder half unit 76*b* supporting the blade 12*b* and the ditch unit 100 formed on the vertical wall unit 94*a* and 94*b* for highlighting the relationship between them.

Figure 7A:
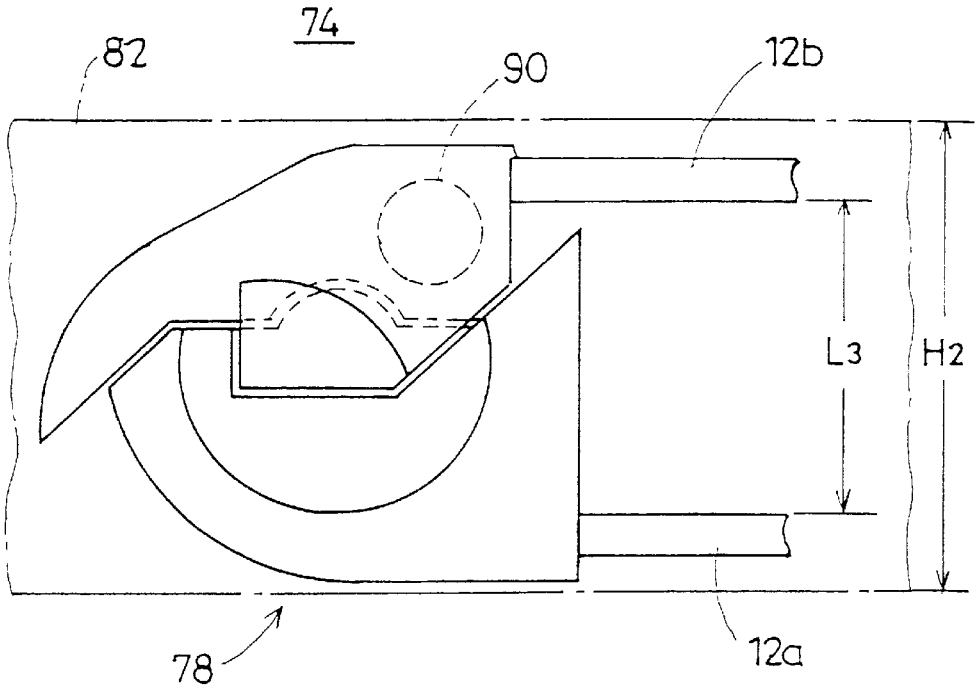
FIG. 7A is a schematic drawing showing the movement of the plug of the AC adapter showed in FIG. 6 where blades are stored in the case.
Figure 7B:
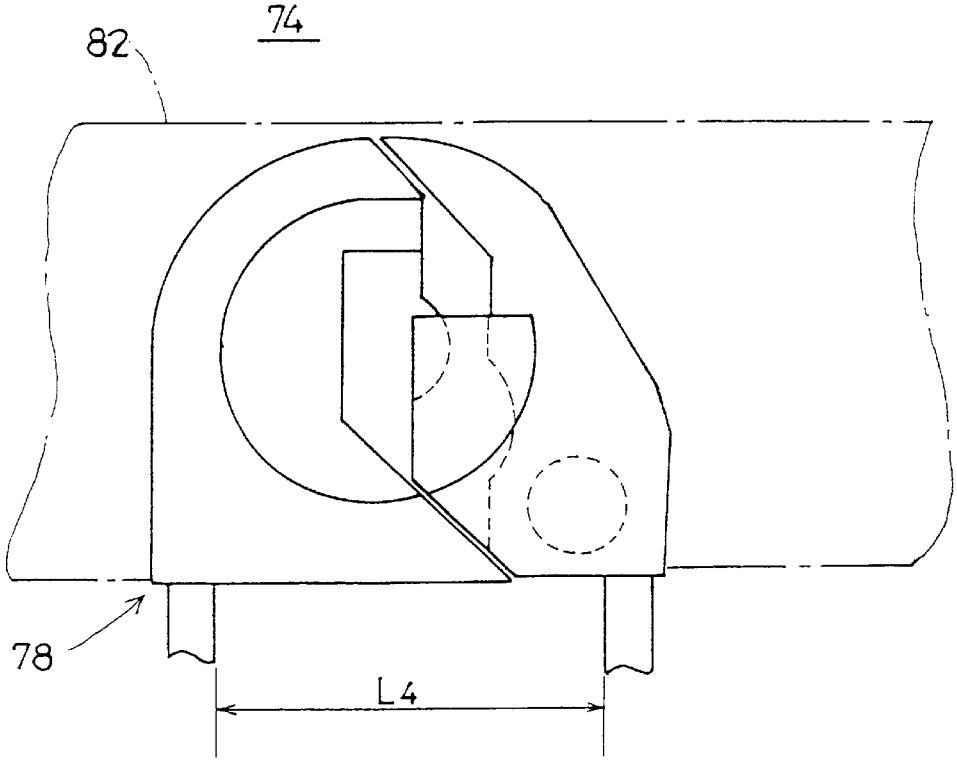
FIG. 7B is a schematic drawing showing the movement of the plug of the AC adapter showed in FIG. 6 where blades are raised out of the case.
Figure 8A:
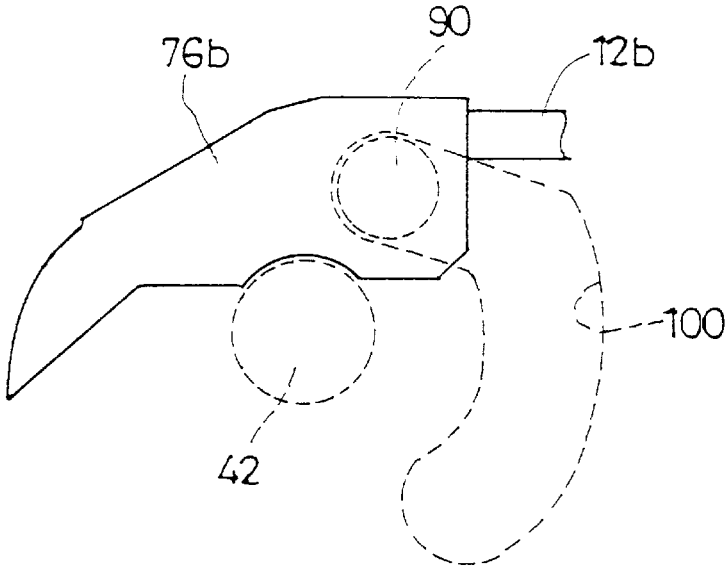
FIG. 8A is a schematic drawing showing one of the holder half units and the guiding groove in a state corresponding to FIG. 7A.
Figure 8B:
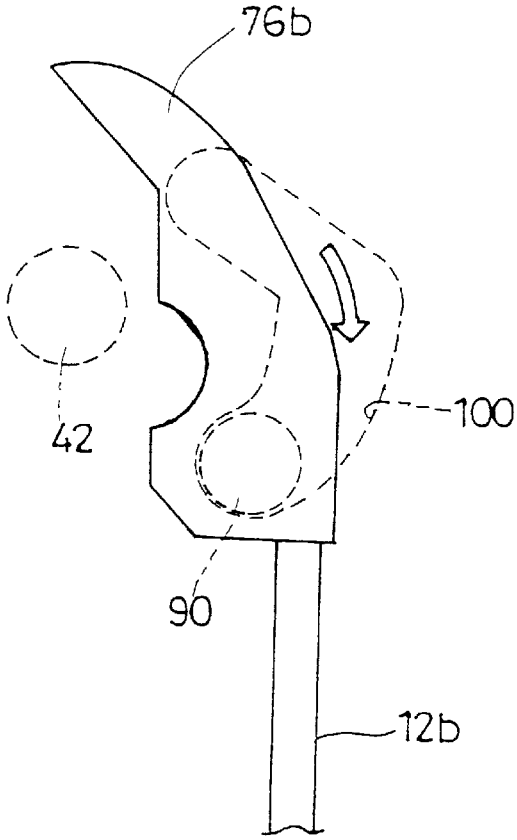
FIG. 8B is a schematic drawing showing one of the holder half units and the guiding groove in a state corresponding to FIG. 7B.
Figure 9A:
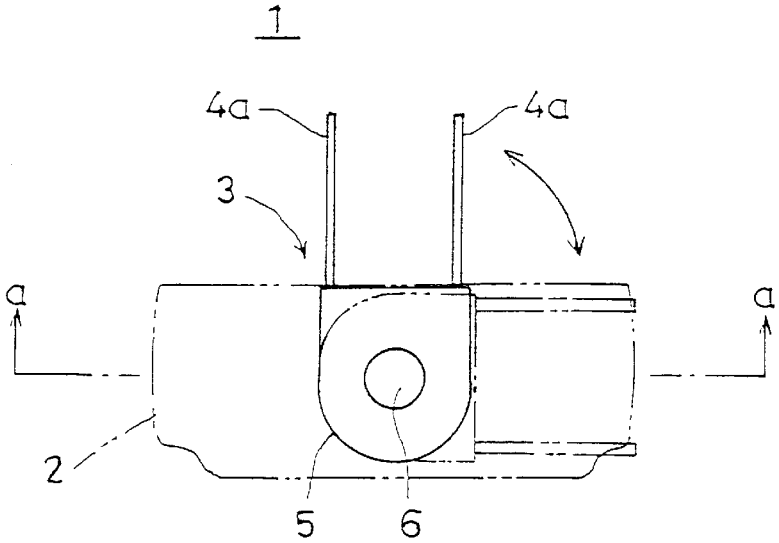
FIG. 9A is a side view showing a conventional AC adapter where blades are raised out of the case.
Figure 9B:
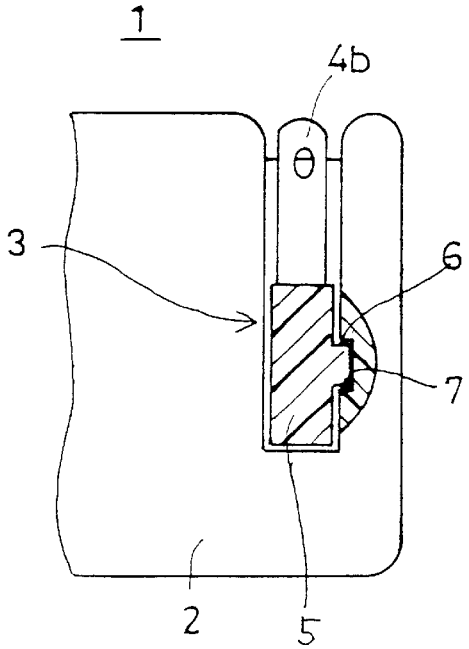
FIG. 9B is a partial sectional view showing the conventional AC adapter where blades are stored in the case.

As showed in FIG. 7A, when the AC adapter 74 is not used, the plug 78 is stored in the case 82. As shown in FIG. 8A, the protrusion unit 90 stays in the guiding ditch 100 at the nearest position to-the rotative axis 42 (or corresponding bearing unit) where two holder half units 76*a* and 76*b* are attached the most closely. Based on the distance L3 between the blades 12*a* and 12*b*, the thickness H2 of the case 22 is determined.

When the AC adapter 74 is in use, the blades 12*a* and 12*b* are drawn out of the case 22. The holder half unit 76*a* supporting the blade 12*a* rotates around the rotative axis 88 and 42 (see FIG. 6). On the other hand, as shown in FIG. 8B, the holder half unit 76*b* holding the blade 12*b* moves from the position showed in FIG. 8A off the rotative axis 88 and 42 since the protrusion unit 90 is guided by the guiding ditch 100. The holder half units 76*a* and 76*b* move in different ways and separate from each other. The protrusion unit 90 and the guiding ditch 100 operate as the distance adjustment mechanism.

The holder half unit 76*a* moves along a stopper unit (not shown) of the case 82. The holder half unit 76*a* stops when the blade 12*a* is drawn out of the case 82 by 90 degrees and fixed. The holder half unit 76*a* does not separate from the holder half unit 76*b* more than a predetermined distance.

When being drawn out of the case 82, the distance L4 between blades 12*a* and 12*b* is a predetermined distance defined as the industrial standard.

The AC adapter 74 as the second embodiment of the present invention provides the same effect as the AC adapter 10 as the first embodiment of the present invention.

The preferred embodiments of the present invention are described above. The present invention is not limited to these embodiments, but various variations and modifications may be made without departing from the scope of the present invention.

This patent application is based on Japanese priority patent application No. 2001-175816 filed on Jun. 11, 2001, the entire contents of which are hereby incorporated by reference.

What is claimed is:

1. An AC adapter, comprising:

a case;

a plug that can be rotated by 90 degrees about one axis relative to said case, so that said plug can be stored in said case and drawn out of said case; and a blade distance adjusting unit;

wherein said plug further comprises a pair of sub-holders, each holding a blade; and said blade distance adjusting unit causes at least one of said pair of sub-holders to slidingly approach the other to reduce the distance between the blades when said plug is stored in said case, and to slidingly separate from the other to increase the distance between the blades when said plug is drawn out of said case.

2. The AC adapter claimed in claim 1, wherein said plug has a rotative axis perpendicular to the plane in which said plug is rotated to be drawn out of said case;

said case has a bearing unit that supports said rotative axis of said plug;

said blade distance adjusting unit comprises a tongue unit formed on one of the sub-holders;

said blade distance adjusting unit further comprises a convex stripe unit formed near said bearing unit, said convex stripe unit being substantially "L"-shaped; and said tongue unit is guided by said convex stripe unit when said plug is rotated around said rotative axis so that the distance between the blades is adjusted.

3. The AC adapter claimed in claim 1, wherein said plug has a rotative axis perpendicular to the plane in which said plug is rotated to be drawn out of said case;

said case has a bearing unit that supports said rotative axis of said plug;

said blade distance adjusting unit comprises a protrusion unit formed on a side face of the sub-holders;

said blade distance adjusting unit further comprises a guiding ditch unit formed near said bearing unit, said guiding ditch unit being substantially "L"-shaped; and said protrusion unit is guided by said guiding ditch unit when said plug is rotated around said rotative axis so that the distance between the blades is adjusted.

4. The AC adapter claimed in claim 2, further comprising:

a circuit board provided in said case;

wherein each of the sub-holders has a stick-shaped contacting unit extruded in parallel to said rotative axis, said contacting unit being electrically connected to the blade held by the sub-holder;

a pair of elastic contacts facing each other stand on said circuit board; and said contacting unit separates from the contact when said plug is stored in said case and touches the contact when said plug is drawn out of said case.

5. The AC adapter claimed in claim 3, further comprising:

a circuit board provided in said case;

wherein each of the sub-holders has a stick-shaped contacting unit extruded in parallel to said rotative axis, said contacting unit being electrically connected to the blade held by the sub-holder;

a pair of elastic contacts facing each other stand on said circuit board; and said contacting unit separates from the contact when said plug is stored in said case and touches the contact when said plug is drawn out of said case.

* * * * *